US007914255B2

(12) United States Patent
Workman et al.

(10) Patent No.: US 7,914,255 B2
(45) Date of Patent: Mar. 29, 2011

(54) APPARATUS AND METHOD OF DIAPHRAGM ASSEMBLY

(75) Inventors: Alexander W. Workman, Schenectady, NY (US); Jeffery Gerald, Holden, ME (US); Richard C. Jesionowski, Schenectady, NY (US); Mark Bowen, Niskayuna, NY (US); Daniel Ray Foote, Jr., Waterford, NY (US)

(73) Assignee: General Electric Company, Schenectady, NY (US)

( * ) Notice: Subject to any disclaimer, the term of this patent is extended or adjusted under 35 U.S.C. 154(b) by 398 days.

(21) Appl. No.: 11/408,494

(22) Filed: Apr. 21, 2006

(65) Prior Publication Data

US 2007/0248455 A1 Oct. 25, 2007

(51) Int. Cl.
*F01D 1/02* (2006.01)

(52) U.S. Cl. ..... 415/190; 415/209.3; 415/209.4; 29/889.22

(58) Field of Classification Search ..... 415/189, 415/190, 209.2, 209.3, 209.4, 240.1, 210.1; 29/889.21, 889.22
See application file for complete search history.

(56) References Cited

U.S. PATENT DOCUMENTS 4,728,258 A * 3/1988 Blazek et al. ..... 415/137
4,955,423 A * 9/1990 Blazek ..... 164/35
4,987,944 A * 1/1991 Parks ..... 164/10
5,069,265 A * 12/1991 Blazek ..... 164/35
5,174,715 A 12/1992 Martin
5,332,360 A 7/1994 Correia et al.
5,474,419 A * 12/1995 Reluzco et al. ..... 415/209.4
5,851,105 A 12/1998 Fric et al.
6,368,055 B1 4/2002 Matsuda
6,547,518 B1 * 4/2003 Czachor et al. ..... 415/137
6,884,030 B2 * 4/2005 Darkins et al. ..... 415/191

FOREIGN PATENT DOCUMENTS

JP 04094402 A * 3/1992

* cited by examiner

*Primary Examiner* — Edward Look
*Assistant Examiner* — Aaron R Eastman
(74) *Attorney, Agent, or Firm* — Armstrong Teasdale LLP

(57) ABSTRACT

A method facilitates assembling a diaphragm assembly for a steam turbine. The method includes forming at least one opening within a radially outer band and forming at least one opening within a radially inner band. The method further includes coupling at least one partition to at least one opening within the radially outer band including a radially inner surface and a radially outer surface wherein the at least one opening is at least partially defined by a wall that extends obliquely between the outer band radially inner surface and the outer band radially outer surface. The method additionally includes coupling the at least one partition to the at least one opening within the radially inner band wherein the at least one partition extends between the at least one radially outer band opening and the at least one radially inner band opening.

19 Claims, 4 Drawing Sheets

APPARATUS AND METHOD OF DIAPHRAGM ASSEMBLY

BACKGROUND OF THE INVENTION

This invention relates generally to turbines and more particularly to diaphragm assemblies used with steam turbines.

At least some known steam turbines include diaphragm assemblies that channel flow downstream to rotating turbine blades. Known diaphragm assemblies are stationary and include a plurality of circumferentially spaced partitions. Each partition extends generally radially between an outer band and an inner band. At least some known bands are formed with openings that extend through the band. A cross-sectional shape of the opening is substantially similar to a cross-sectional profile of the partitions.

During assembly of the diaphragm assembly, each partition is aligned with a respective band opening and the partitions are then inserted through the opening such that the partitions are retained in position between the bands. However, because known turbines and diaphragms use advanced aero-shaped partitions, such as bowed partitions, inserting the partitions through the openings may be a difficult task. Specifically, the bowed cross-sectional shape of the partitions may make it difficult to align the partitions with the openings. Such alignment problems, known as fit-up issues, generally increase as the amount of the bow increases and/or as a thickness of a band increases.

To facilitate reducing fit-up issues, at least some known turbines use "booted partitions" to reduce the likelihood of interference between the bands and partitions during assembly. More specifically, within such turbines, the overall size of the openings formed in at least one band are increased such that a clearance gap is defined between the partitions and the bands. A boot is coupled around the partitions to close the gap. However, the booted partitions cause a radial step to be defined at the interface between the boot and the band. The radial steps create flow disturbances reducing the overall stage efficiency and generally such partitions require a larger signature footprint within the turbine.

BRIEF DESCRIPTION OF THE INVENTION

In one aspect, a method of assembling a diaphragm assembly for a steam turbine is provided. The method includes forming at least one opening within a radially outer band and forming at least one opening within a radially inner band. The method also includes coupling at least one partition to at least one opening within the radially outer band including a radially inner surface and a radially outer surface wherein the at least one opening is at least partially defined by a wall that extends obliquely between the outer band radially inner surface and the outer band radially outer surface. The method additionally includes coupling the at least one partition to the at least one opening within the radially inner band wherein the at least one partition extends between the at least one radially outer band opening and the at least one radially inner band opening.

In another aspect, a diaphragm assembly for a steam turbine is provided. The diaphragm assembly includes a radially inner band including a radially inner surface, an opposite radially outer surface, and a plurality of openings extending therebetween. The diaphragm assembly also includes a radially outer band including an opposite radially inner surface, a radially outer surface, and a plurality of openings extending therebetween. The diaphragm assembly additionally includes at least one partition extending between the inner band and the outer band wherein at least one of the radially outer band openings is at least partially defined by a wall that extends obliquely between the outer band radially inner surface and the outer band radially outer surface.

In a further aspect, a steam turbine is provided. The steam turbine includes an inner carrier, an outer carrier, and a diaphragm assembly for a steam turbine. The diaphragm assembly includes a radially inner band including a radially inner surface, an opposite radially outer surface, and a plurality of openings extending therebetween. The diaphragm assembly also includes a radially outer band including an opposite radially inner surface, a radially outer surface, and a plurality of openings extending therebetween. The diaphragm assembly additionally includes at least one partition extending between the inner band and the outer band wherein at least one of the radially outer band openings is at least partially defined by a wall that extends obliquely between the outer band radially inner surface and the outer band radially outer surface.

DETAILED DESCRIPTION OF THE INVENTION

Figure 1:
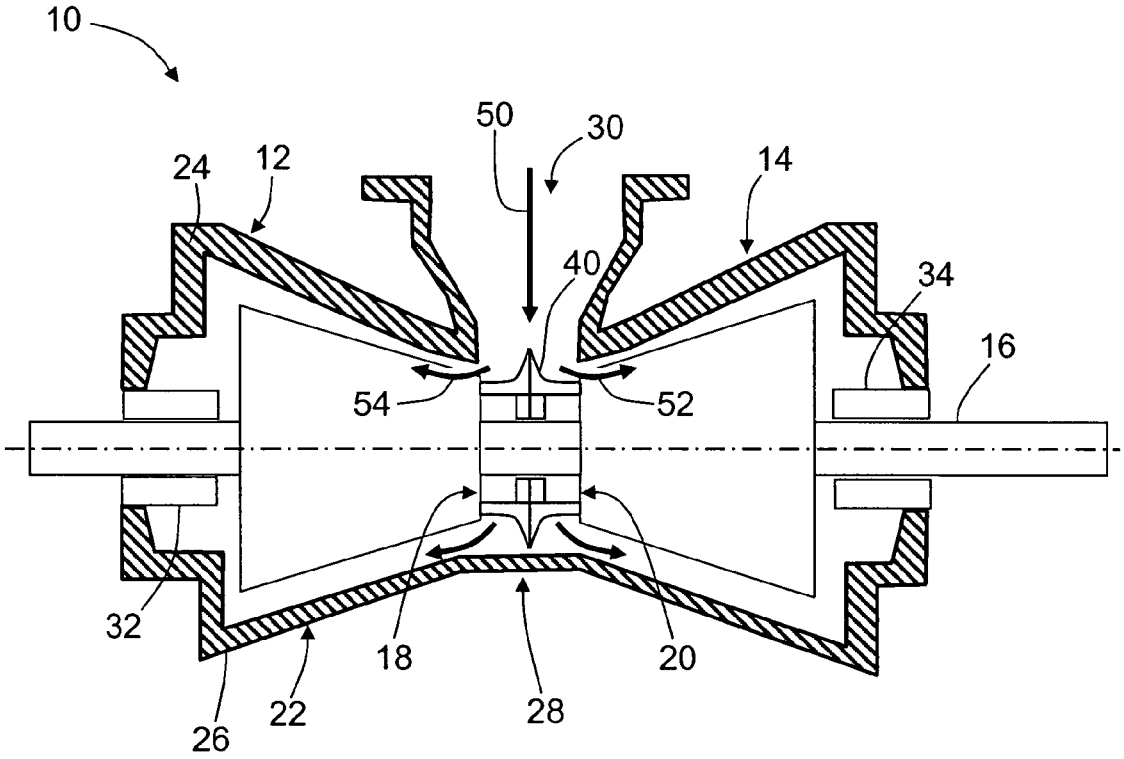
FIG. 1 is a schematic view of an exemplary steam turbine.

FIG. 1 is a schematic illustration of an exemplary opposed-flow steam turbine 10. Turbine 10 includes first and second low pressure (LP) sections 12 and 14. As is known in the art, each turbine section 12 and 14 includes a plurality of stages of diaphragms (not shown in FIG. 1). A rotor shaft 16 extends through sections 12 and 14. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

It should be noted that although FIG. 1 illustrates a double flow low pressure turbine, as will be appreciated by one of ordinary skill in the art, the present invention is not limited to being used with low pressure turbines and can be used with any double flow turbine including, but not limited to intermediate pressure (IP) turbines or high pressure (HP) turbines. In addition, the present invention is not limited to being used with double flow turbines, but rather may be used with single flow steam turbines as well, for example.

During operation, low pressure steam inlet 30 receives low pressure/intermediate temperature steam 50 from a source, for example, an HP turbine or IP turbine through a cross-over pipe (not shown). The steam 50 is channeled through inlet 30 wherein flow splitter 40 splits the steam flow into two opposite flow paths 52 and 54. More specifically, the steam 50 is routed through LP sections 12 and 14 wherein work is extracted from the steam to rotate rotor shaft 16. The steam exits LP sections 12 and 14 and is routed to a condenser, for example.

Figure 2:
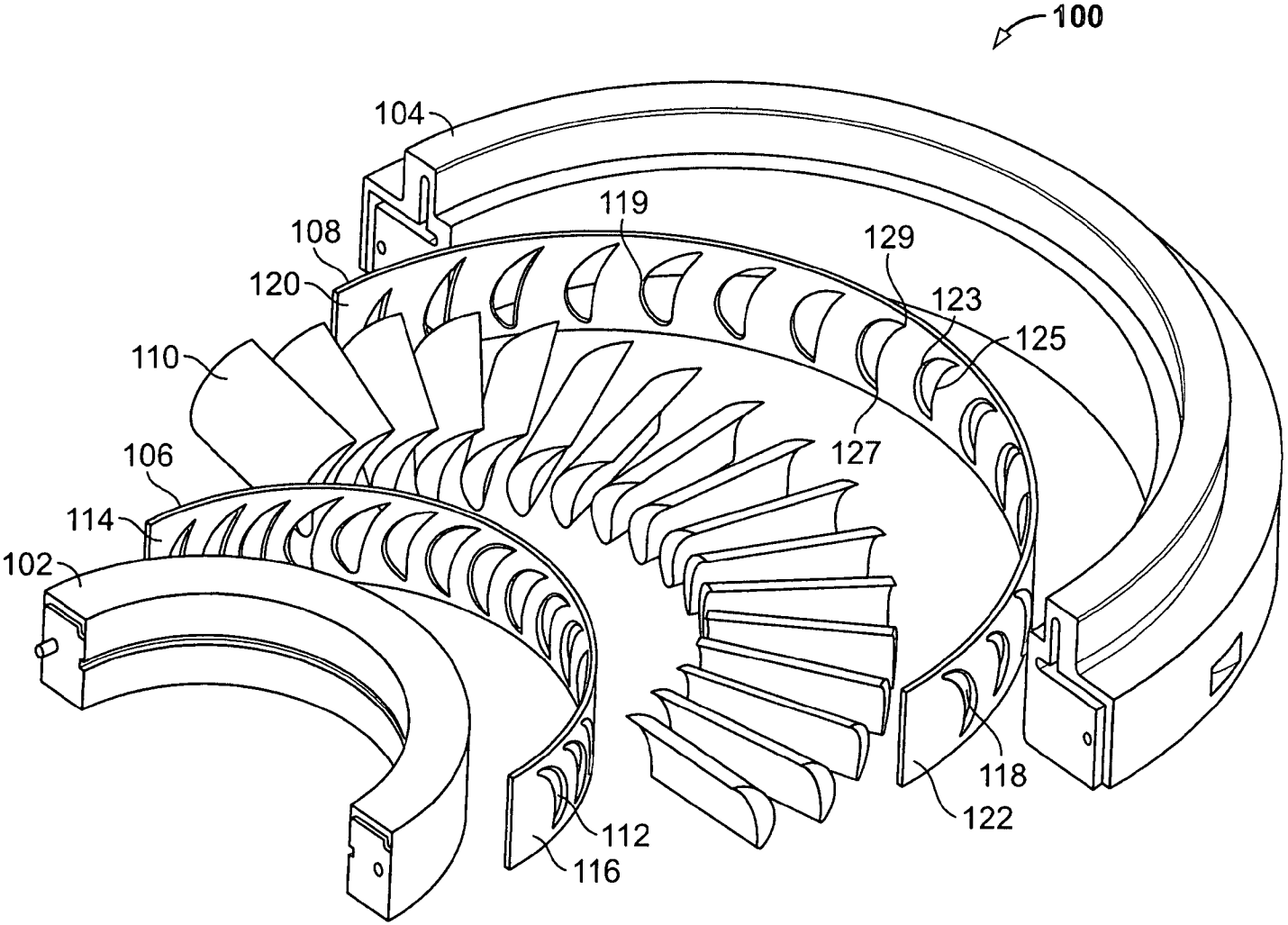
FIG. 2 is an exploded view of an exemplary diaphragm assembly that may be used with the steam turbine shown in FIG. 1.
Figure 3:
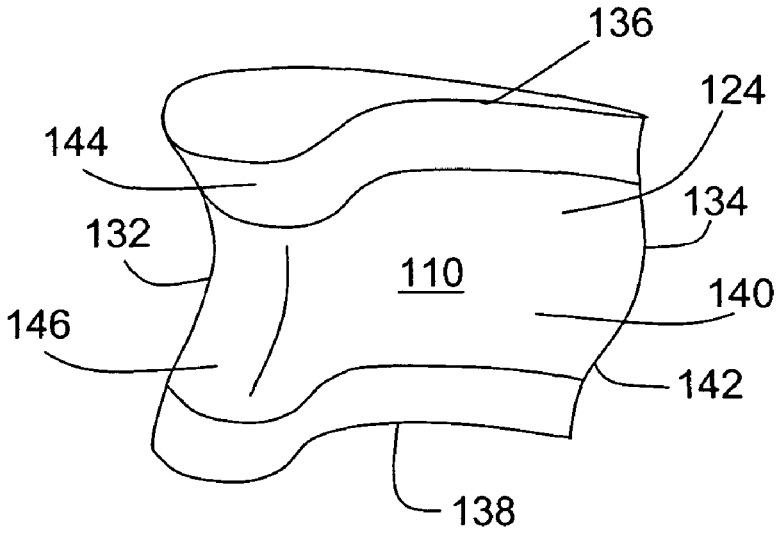
FIG. 3 is a perspective view of a partition used with the diaphragm assembly shown in FIG. 2.
Figure 4:
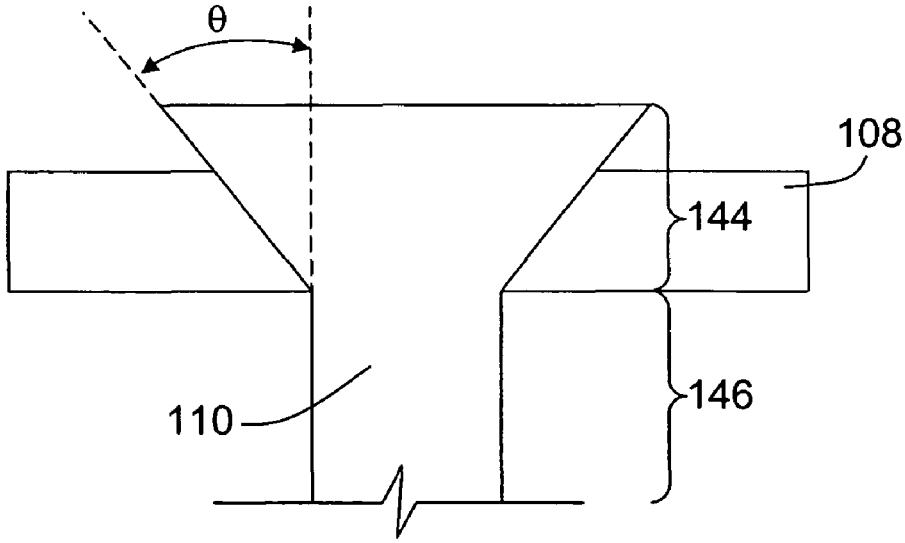
FIG. 4 is a cross-sectional view of a portion of the partition (shown in FIG. 3) coupled to an outer band used with the diaphragm assembly shown in FIG. 2.
Figure 5:
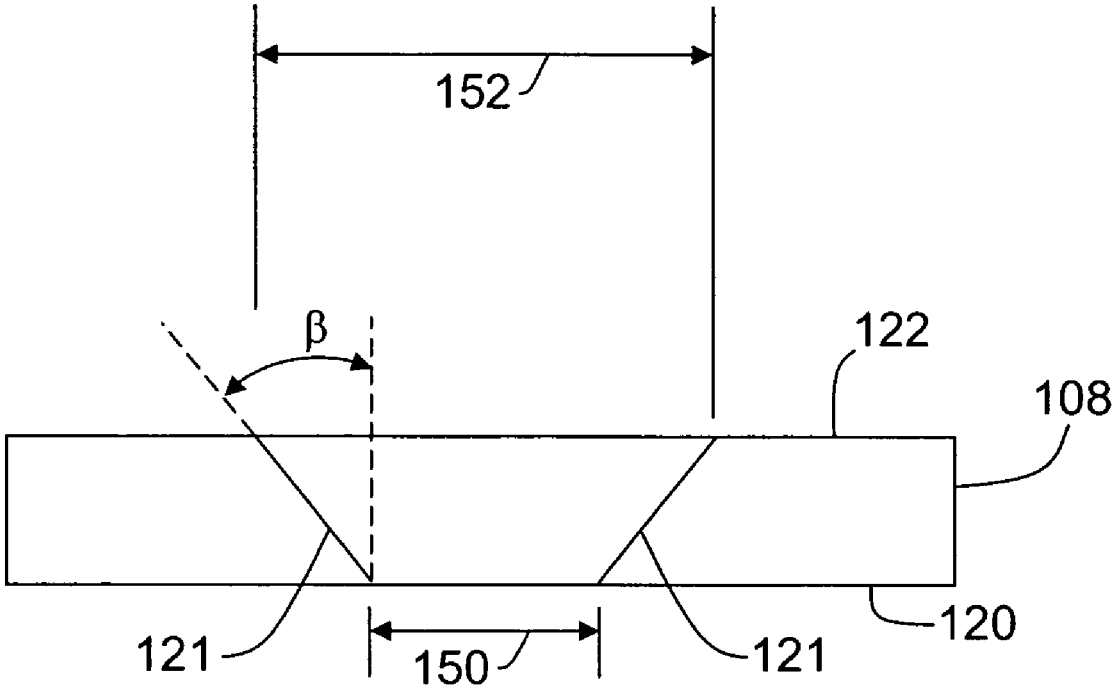
FIG. 5 is a schematic illustration of a portion of the outer band shown in FIG. 4.

FIG. 2 is an exploded view of a diaphragm assembly 100 that may be used with steam turbine 10 (shown in FIG. 1). FIG. 3 is a perspective view of a partition 110 used with diaphragm assembly 100. FIG. 4 is a cross-sectional view of a portion of partition 110 coupled to an outer band 108 used with diaphragm assembly 100. FIG. 5 is a schematic illustration of a portion of outer band 108.

Diaphragm assembly 100 includes an inner carrier 102 and an outer carrier 104. Diaphragm assembly 100 also includes a radially inner band 106, radially outer band 108, and a plurality of circumferentially-spaced partitions 110 that extend generally radially between inner carrier 102 and outer carrier 104. Radially outer carrier 104 is radially outward from, and adjacent to, radially outer band 108,and radially inner carrier 102 is radially inward of, and adjacent to radially inner band 106.

Radially inner band 106 includes a plurality of openings 112 that extend through inner band 106 from a radially inner surface 114 of inner band 106 to a radially outer surface 116 of inner band 106. Openings 112 are circumferentially-spaced along inner band 106, and in the exemplary embodiment, openings 112 are each substantially identical. Radially outer band 108 also includes a plurality of openings 118 that extend through outer band 108 from a radially inner surface 120 of outer band 108 to a radially outer surface 122 of outer band 108. In the exemplary embodiment, surfaces 120 and 122 are substantially parallel to each other. In the exemplary embodiment, openings 118 are each substantially identical. Openings 118 and 112 are aerodynamically shaped and with a contoured shape that is substantially identical to a cross-sectional shape defined by an exterior surface 124 of partitions 110. As such, openings 112 and 118 are sized to receive partitions 110.

More specifically, in the exemplary embodiment, openings 118 and 112 are each substantially airfoil-shaped. In the exemplary embodiment, each inner band opening 112 is approximately the same size, or is slightly smaller, than each outer band opening 118.

Each opening 118 is defined by a wall 121 that extends between outer surface 122 and inner surface 120 and forms a perimeter 119 that circumscribes opening 118. Moreover, in the exemplary embodiment, wall 121 includes a ruled surface. Wall 121 is oriented obliquely, with respect to surface 120 or 122, around a portion of perimeter 119 of at least one opening 118. Specifically, within a portion of perimeter 119, wall 121 is oriented at an oblique angle $\beta$ with respect to outer band 108. Angle $\beta$ varies around perimeter 119. More specifically, along circumferential sides 123 and 125 of opening 118, angle $\beta$ is at its largest oblique angle while at leading edge and trailing edge sides 127 and 129 of opening 118, angle $\beta$ is at its minimum oblique angle. Accordingly, in the exemplary embodiment, because wall 121 is oriented at least partially around perimeter 119, a cross-sectional area 150 of each opening 118 adjacent radially outer surface 122 is larger than a cross-sectional area 152 of each opening 118 adjacent radially inner surface 120.

Each partition 110 extends between inner and outer bands 106 and 108, respectively, and are circumferentially spaced as defined by generally radially openings 112 and 118. In the exemplary embodiment, partitions 110 each have an aerodynamic cross-sectional shape that is substantially identical to that of openings 118 and 112. Partitions 110 may have any geometric shape that may be variably selected to facilitate increasing diaphragm assembly 100 performance and/or increasing coupling strength between partitions 110 and inner and outer bands 106 and 108. In one embodiment, partitions 110 are bowed.

In the exemplary embodiment, each partition 110 includes a pair of opposing sidewalls 140 and 142 coupled together at a leading edge 132 and a trailing edge 134. In the exemplary embodiment, sidewall 140 is a convex surface and sidewall 142 is a concave surface. Each partition 110, in the exemplary embodiment, includes a flared portion 144 and a blade portion 146. Flared portion 144 extends across an oblique angle $\theta$ from blade portion 146. Angle $\theta$ varies across sidewalls 140 and 142 from leading edge 132 to trailing edge 134 in an orientation that substantially mirrors the orientation of outer band 108 wall angle $\beta$. As such, at trailing edge 134 and leading edge 132, angle $\theta$ is at its minimum angle.

During assembly, partitions 110 are each aligned such that the partitions 110 are substantially aligned with openings 118. In the exemplary embodiment, partitions 110 are inserted through outer band 108 from the radially outer surface 122 of outer band 108. The combination of two flared sidewall portions and the angular orientation of wall 121 facilitates creating a snug fit between an inner surface of each outer band opening 118 and an outer surface of each partition 110. Similarly, partitions 110 are aligned with openings 112 and inserted through openings 112. Flared openings 112 and 118 and flared partitions 110 facilitate coupling partition 110 to openings 112 and 118 and provide adequate clearance for partitions 110 to be inserted into openings 112 and 118. In an alternative embodiment, partitions 110 may be welded to inner and outer bands 106 and 108 around partition perimeters 136, 138. In another embodiment, partitions 110 may be secured to inner and outer bands 106 and 108 with a mechanical joint. After coupling partitions 110 to inner and outer bands 106 and 108, radially inner and outer bands 106 and 108 are then coupled to radially inner and outer carriers 102 and 104.

During assembly of known diaphragm assemblies, alignment problems, known as fit-up issues, frequently arise. Flared partitions and flared openings reduce fit-up issues without causing a radial step in the diaphragm assembly. Radial steps in known diaphragm assemblies create flow disturbances reducing the overall stage efficiency. Through eliminating the radial step, the engine operates more efficiently. Additionally, a diaphragm assembly with flared openings and partitions reduces the axial space necessary for the assembly, because known partitions, such as bowed partitions, require a large signature footprint within the turbine. Because the flared portion of the above-described diaphragm assembly is shallow near leading and trailing edges of partitions, the outer band maintains sufficient material for adequate axial ligaments and structural integrity between each opening and leading and trailing edges of the outer band.

The above-described diaphragm assembly includes an outer band that includes a plurality of contoured openings defined at least partially by an oblique wall. The assembly also includes partitions that extend between the inner and outer bands and that each include a flared sidewall portion. The combination of the oblique openings and flared sidewall portions of the partitions facilitate reducing difficulty in assembling the diaphragm assembly.

Exemplary embodiments of a diaphragm assembly are described above in detail. The diaphragm assembly is not limited to use with the specific embodiments described herein, but rather, the diaphragm assembly can be utilized independently and separately from other components described herein. Moreover, the invention is not limited to the embodiments of the diaphragm assembly described above in detail. Rather, other variations of a diaphragm assembly may be utilized within the spirit and scope of the claims.

While the invention has been described in terms of various specific embodiments, those skilled in the art will recognize that the invention can be practiced with modification within the spirit and scope of the claims.

What is claimed is:

1. A method of assembling a diaphragm assembly for a steam turbine, said method comprising:

forming at least one opening within a radially outer band;

forming at least one opening within a radially inner band, wherein the inner band opening is approximately the same size as the outer band opening;

coupling at least one partition to the at least one opening defined within the radially outer band such that the at least one partition is secured substantially stationary relative to the radially outer band, said coupling the at least one partition to the at least one opening within the radially outer band comprises inserting the at least one partition through the at least one opening defined within the radially outer band such that the at least one partition extends between the at least one radially outer band opening and the at least one radially inner band opening, wherein the radially outer band includes:

a radially inner surface; and a radially outer surface, wherein a perimeter of the at least one opening is at least partially defined by a wall that extends between the outer band radially inner surface and the outer band radially outer surface at an oblique angle with respect to the outer band outer surface, and wherein the wall includes at least two sides extending between a leading edge and a trailing edge, each of the leading and the trailing edges is oriented at a first oblique angle, each of the two sides is oriented at a second oblique angle that is larger than the first oblique angle to facilitate minimizing the first oblique angle at the leading edge and at the trailing edge of the at least one opening.

2. A method in accordance with claim 1 wherein the at least one partition includes a convex and a concave surface, said method further comprising positioning the at least one partition within the at least one opening within the radially outer band such that steam within the steam turbine will flow along the concave surface of the at least one partition.

3. A method in accordance with claim 1 wherein the at least one partition includes a pair of sidewalls, each of the sidewalls includes a flared portion, said method further comprising coupling the at least one partition to the radially outer band.

4. A method in accordance with claim 1 said method further comprising coupling inner and outer bands to an inner and outer carrier of a steam engine.

5. A diaphragm assembly for a steam turbine, said diaphragm assembly comprising:

a radially inner band comprising a radially inner surface, an opposite radially outer surface, and a plurality of openings extending therebetween;

a radially outer band comprising a radially inner surface, an opposite radially outer surface, and a plurality of openings extending therebetween, each of said inner band openings is approximately the same size as each of said outer band openings; and at least one partition extending between said inner band and said outer band, wherein a perimeter of at least one of said radially outer band openings is at least partially defined by a wall that extends obliquely between said outer band radially inner surface and said outer band radially outer surface, said oblique wall comprising at least two sides extending between a leading edge and a trailing edge, said at least one of said radially outer band openings is sized to receive said at least one partition there through, wherein said oblique wall is oriented at an oblique angle β with respect to said outer band outer surface and wherein each of said leading and said trailing edges is oriented at a first oblique angle, each of said at least two sides is oriented at a second oblique angle that is larger than said first oblique angle to facilitate minimizing said angle β at said leading edge and at said trailing edge of said at least one radially outer band opening, said at least one partition coupled to said oblique wall such that said at least one partition is secured substantially stationary relative to said radially outer band.

6. A diaphragm assembly in accordance with claim 5 wherein said plurality of openings in said inner and said outer bands are circumferentially spaced.

7. A diaphragm assembly in accordance with claim 5 wherein a cross-sectional area of each of said plurality of openings at said outer band outer surface is larger than a cross-sectional area of each opening at said outer band inner surface.

8. A diaphragm assembly in accordance with claim 5 wherein said at least one partition includes a convex surface and a concave surface said concave surface is configured such that steam from the steam turbine will flow along said concave surface.

9. A diaphragm assembly in accordance with claim 5 wherein each of said outer band plurality of openings is defined by a perimeter, said oblique wall extends only partially around said perimeter of said at least one radially outer band opening.

10. A diaphragm assembly in accordance with claim 9 wherein said radially outer band wall is oriented at an oblique angle β with respect to said outer band, said angle β varies around said perimeter.

11. A diaphragm assembly in accordance with claim 5 wherein said at least one partition comprises a pair of sidewalls coupled together at a leading edge and a trailing edge, each of said sidewalls comprises a flared portion extending outward therefrom to facilitate coupling said at least one partition to said radially outer band.

12. A diaphragm assembly in accordance with claim 11 wherein said flared portion extends between said sidewall and said outer band radially inner surface.

13. A steam turbine comprising:

an inner carrier;

an outer carrier; and a diaphragm assembly for a steam turbine, said diaphragm assembly comprising:

a radially inner band comprising a radially inner surface, an opposite radially outer surface, and a plurality of openings extending therebetween;

a radially outer band comprising a radially inner surface, an opposite radially outer surface, and a plurality of openings extending therebetween, wherein each of said inner band openings is approximately the same size as each of said outer band openings; and at least one partition extending between said inner band and said outer band, wherein at least one of said radially outer band openings is at least partially defined by a wall that extends obliquely between said outer band radially inner surface and said outer band radially outer surface, said oblique wall comprising at least two sides extending between a leading edge and a trailing edge, said at least one of said radially outer band openings is sized to receive said at least one partition there through, wherein said oblique wall is oriented at an oblique angle β with respect to said outer band outer surface and wherein each of said leading and said trailing edges is oriented at a first oblique angle, each of said at least two sides is oriented at a second oblique angle that is larger than said first oblique angle to facilitate minimizing said angle β at said leading edge and at said trailing edge of said at least one radially outer band opening, said at least one partition coupled to said oblique wall such that said at least one partition is secured substantially stationary relative to said radially outer band.

14. A steam turbine in accordance with claim 13 wherein said plurality of openings in said inner and said outer bands are circumferentially spaced, each of said plurality of openings in said inner band is smaller than each of said plurality of openings in said outer band.

15. A steam turbine in accordance with claim 13 wherein a cross-sectional area of each of said plurality of openings at said outer band outer surface is larger than a cross-sectional area of each of said plurality of openings at said outer band inner surface.

16. A diaphragm assembly in accordance with claim 13 wherein said at least one partition comprises a pair of sidewalls coupled together at a leading edge and a trailing edge, each of said sidewalls comprises a flared portion extending outward therefrom to facilitate coupling said at least one partition to said radially outer band.

17. A diaphragm assembly in accordance with claim 16 wherein said flared portion extends between said sidewall and said outer band radially inner surface.

18. A steam turbine in accordance with claim 13 wherein each of said outer band plurality of openings is defined by a perimeter, said oblique wall extends only partially around said perimeter of said at least one radially outer band opening.

19. A diaphragm assembly in accordance with claim 18 wherein said radially outer band wall is oriented at an oblique angle β with respect to said outer band, said angle β varies around said perimeter.

* * * * *